US005647103A

United States Patent [19]

Foster

[11] Patent Number: 5,647,103

[45] Date of Patent: Jul. 15, 1997

[54] BEVELED CLASP

[76] Inventor: Robert A. Foster, 5545 Lehigh, Imperial, Mo. 63052

[21] Appl. No.: 586,606

[22] Filed: Jan. 16, 1996

[51] Int. Cl.[6] ..... A44B 17/00

[52] U.S. Cl. ..... 24/618; 24/681

[58] Field of Search ..... 24/107, 108, 90.1, 24/705, 700, 681, 662, 614, 618, 619, 623, 625, 572; 29/525, 451; 403/280; 411/338, 339, 512

[56] References Cited

U.S. PATENT DOCUMENTS

| | | | |
|---|---|---|---|
| Re. 34,381 | 9/1993 | Barnes . | |
| 206,037 | 7/1878 | Mumford . | |
| 603,303 | 5/1898 | Washburne | 24/662 |
| 646,738 | 4/1900 | Ingalls | 411/339 |
| 1,056,452 | 3/1913 | Remhilt | 411/338 |
| 1,975,971 | 10/1934 | Nothnagel | 411/338 |
| 3,080,633 | 3/1963 | Reddy . | |
| 3,234,615 | 2/1966 | Martinez . | |
| 3,286,316 | 11/1966 | Marosy . | |
| 3,367,000 | 2/1968 | Schluter . | |
| 3,470,524 | 9/1969 | Culver . | |
| 3,487,512 | 1/1970 | Marosy . | |
| 3,540,087 | 11/1970 | Marosy . | |
| 3,540,091 | 11/1970 | Marosy . | |
| 3,675,499 | 7/1972 | Marosy . | |
| 3,900,927 | 8/1975 | D'Angelo et al. . | |
| 4,055,057 | 10/1977 | Kolman . | |
| 4,184,232 | 1/1980 | Marosy . | |
| 4,216,567 | 8/1980 | Heinz . | |
| 4,236,283 | 12/1980 | Marosy . | |
| 4,242,778 | 1/1981 | Kay . | |
| 4,364,155 | 12/1982 | Synowicki . | |
| 4,522,541 | 6/1985 | Bidwell . | |
| 4,679,959 | 7/1987 | Cavallaro . | |
| 4,694,544 | 9/1987 | Chapman | 24/625 |
| 4,709,454 | 12/1987 | Barnes . | |
| 4,811,469 | 3/1989 | Rise | 24/662 X |
| 5,095,594 | 3/1992 | Marosy . | |
| 5,096,236 | 3/1992 | Thony . | |
| 5,155,893 | 10/1992 | Nussberger . | |
| 5,201,858 | 4/1993 | Otrusina . | |
| 5,222,988 | 6/1993 | Riley | 411/339 X |
| 5,274,885 | 1/1994 | Hellweg . | |
| 5,347,693 | 9/1994 | Otrusina . | |

FOREIGN PATENT DOCUMENTS

| | | | |
|---|---|---|---|
| 503461 | 6/1920 | France | 24/623 |
| 333573 | 3/1921 | Germany | 24/623 |
| 351164 | 4/1922 | Germany | 24/681 |
| 6123 | 1/1893 | Switzerland | 24/623 |
| 11182 | 11/1895 | Switzerland | 24/681 |
| 21869 | 8/1929 | United Kingdom | 24/108 |

*Primary Examiner*—James R. Brittain
*Attorney, Agent, or Firm*—Paul M. Denk

[57] ABSTRACT

A clasp formed of beveled members, one a male member and the other a female member, which interengage together and are retained in their connection through capillary and frictional forces. The female member may contain a slot, to facilitate its resilient widening, to receive the male member, once inserted. The male member may include, at its frontal portion, a slot, to provide for its compression, and formation of a bevel proximate its front end to facilitate its interconnection with the female member into the beveled clasp. A modification includes a beaded type connector that interconnects together through the formation of a bead, interiorly of the female member, and a complementary groove, formed proximate the beveled front end of the male member, to facilitate the interconnection of the clasp together, and to sustain its hold during coupling.

2 Claims, 1 Drawing Sheet

BEVELED CLASP

BACKGROUND OF THE INVENTION

This invention relates generally to a beveled clasp, formed of complementary shaped male and female members, that interfit together, and are secured in their retention through the generation of capillary and frictional forces that hold the members together during clasping.

A large variety of clasps have been made available in the art, and such clasps can be used for a variety of purposes, for application in industrial settings for holding two parts together, but more particularly, such clasps are frequently used in the jewelry art, for holding the ends of necklaces, wrist bands, and other items together. Mainly, these prior art style of clasps either use some form of detent means, for interlocking the components together, to assure their retention, but separation of these type of components frequently becomes difficult, particularly for the physically impaired, such as the handicapped, who may be suffering from an arthritic condition, multiple sclerosis, or other impediments that significantly reduce the dexterity of the user to both apply, or remove, the jewelry during usage.

Examples of the type of prior art as previously alluded to can be seen in the prior art U.S. Pat. No. 5,155,893, to Nussberger, showing a coupling device for use as a clasp or the like. As can be seen, the facility to interengage the shown clasp utilizes the detent concept, where a shoulder formed on one part of the coupling device will engage within a slot provided upon the other part, in order to secure the shank and female component together. This does require a little more effort, and secondly, can be a little difficult in obtaining the separation of the clasp once used.

An example of another prior art clasp is shown in the U.S. Pat. No. 4,364,155, to Synowicki, also upon a jewelry clasp, but in this particular instance, the locking engagement is attained through notch alignment where mechanism is provided to provide a latching of the clasp within the formed notches of one part of the shown clasp. Thus, once again, the detent principle is used to secure the clasp into its interengaging relationship.

The U.S. Pat. No. 4,242,778, to Kay, shows a press fit intelligent fastener for random or lightly constrained assembly, but in this particular instance, once again, it is the engagement within the annular cavity of the formed spring biased pawl that secures these complementary components together. Their separation, on the other hand, can entail a little more dexterity, and one that is difficult for the handicapped to achieve.

The U.S. Pat. No. 4,184,232, to Marosy, shows another form of coupling, but in this particular instance, the coupling is made through the bayonet lock type of interconnection, which requires pivotal manipulation of the two components for the coupling, to achieve their assembly, and also their separation.

Another U.S. Pat. No. 3,540,091, to Marosy, shows a related style of bayonet lock form of coupling device, for use for holding various items together, such as the shown chain. It is to be noted, though, that all of these prior art style of couplers require some form of spring biased force exerting parts, to achieve their coupling, and which coupling forces must be relieved, in order to achieve their separation.

The U.S. Pat. No. 3,234,615 to Martinez, shows a tensioning connector, which again utilizes a variety of spring biased means for securing their components together.

The U.S. Pat. No. 3,080,633, to Reddy, shows a separable fastener, which again operates upon the spring biased feature, as can be seen for its leaf spring components that engage within the slots formed behind the plunger head of the shown fastener.

Another U.S. Pat. No. 3,286,316, to Marosy, shows a coupling means that utilizes gearing or serrated surfaces to secure the attachment of the shown coupling together.

The U.S. Pat. No. 3,367,000 to Schluter, shows a detachable fastening device, again one which appears to function off of the bayonet lock style of interconnection.

The U.S. Pat. No. 3,470,524, to Culver, shows a push-pull type of connector, which contains a variety of interconnecting components, including one that incorporates a rather comples cam style locking ring, to secure the components of the connector together.

Another U.S. Pat. No. 3,487,512, to Marosy, shows a form of bayonet lock style of interconnection for its disclosed coupling through the usage of a cam like circular disc forming its locking element.

A further U.S. Pat. No. 3,540,087, to Marosy, shows a bullet shaped coupling, likewise interconneced through a bayonet style of engagement, to provide fastening of two components together.

A further U.S. Pat. No. 3,675,499, to Marosy, shows an earlier style of coupling, through a spring biased member.

The U.S. Pat. No. 3,900,927, to D'Angelo, shows a separable fastener, where a T-lock style of interconnection, which is normally spring biased into engagement, can be assembled into a fastener.

The U.S. Pat. No. 4,055,057, to Kolman, discloses a coupling device for opposed ends of a bracelet, utilizing a spring biased arcuate link for securing one end of the bracelet to the other.

The U.S. Pat. No. 4,216,567, to Heinz, shows a flexible ornamental article and fastener therefor, that appears to operate off the bayonet lock arrangement.

A further U.S. Pat. No. 4,236,283, to Marosy, shows a bayonet style of interconnecting coupling.

The U.S. Pat. No. 4,522,541, to Bidwell, shows a stud fastener receptacle.

The U.S. Pat. No. 4,679,959, to Cavallaro, shows a quick-connect/disconnct connector, which appears to utilize a ball and socket type of interconnection.

A much more complex locking device is shown in the axial style of locking device set forth in the Barnes U.S. Pat. No. 4,709,454.

A further U.S. Pat. No. 5,095,594, to Marosy, shows a spring lock, again off of the bayonet locking principle, for securing a coupling together.

The U.S. Pat. No. 5,347,696, to Otrusina, shows a quick-release connector.

The U.S. Pat. No. 3,080,633, to Reddy, shows a form of separable fastener, which are linked together by means of spring bias leaf springs.

The essence of the current invention is to alleviate the effort that is required to form a clasping connection between, for example, the ends of jewelry, or other linkage, and which includes no moving component that requires manipulation, or the exertion of any effort, to attain the interconnection of the beveled clasp together, while its separation requires nothing more than a slight brief twist, to achieve its disconnection.

SUMMARY OF THE INVENTION

It is the principal object of this invention to provide a beveled clasp that can be interconnected together, simply by the slight exertion of a force interconnecting the male and female members together, and which sustain their hold through capillary and frictional forces, while the separation requires nothing more than a slight twist, to provide its disconnection.

Still another object of this invention is to provide a much more simpler way for interconnecting jewelry necklaces, dog tags, bracelets, and the like together, through the exertion of only a slight force.

Still another object of this invention is to provide a beveled clasp that can be interconnected together through a slide engagement.

Still another object of this invention is to provide a beveled clasp that can be easily forced apart, just in the event should the jewelry, necklace, or the like, be inadvertently caught in machinery, in order to provide for its quick disconnection.

Still another object of this invention is to provide the interconnection of a beveled clasp together, that is much more facilely applied by the handicapped, such as those suffering from an arthritic condition, multiple sclerosis, or other physical impairments, that make it very difficult for the individual to manipulate their own Jewelry, either when applying it, or disconnecting its clasp during removal.

Yet another object of this invention is to provide a beveled clasp that is easily connected, very strong in retention, facile of removal, and can be easily separated either manually, or simply pulled apart through the exertion of a slight separating force.

Still another object is to provide a beveled clasp that is secured together and held in securement by means of a capillary force.

Yet another object of this invention is to provide a beveled clasp that may be secured together through a frictional engagement.

These and other objects may become more apparent to those skilled in the art upon reviewing the summary of the invention provided herein, in light of the description of the preferred embodiment.

This invention contemplates a beveled clasp, of the type that utilizes a pair of beveled members, one comprising a female member, and the other a male member, the two of which have a slight bevel along their length, and which when forced together, through a slight exerting effort, can be secured together by a combination of capillary action, and frictional forces that strongly hold the clasp into its coupling relationship. The female member may be formed having a cylindrical like portion at its frontal end, and which includes one or more of a small slot extending along its length, so as to provide some resiliency to retention of the male member therein, when coupled. The male member may include also a cylindrical portion, and have one or more slots provided therein, or the male member may be formed as a solid member, having a longitudinal length, and a portion of its length formed having a slot therealong, which when compressed, forms a slight bevel to facilitate its insertion into the female member, and retention therein, throught the sliding relationship formed between the interior surface of the female member, and the beveled external surface of the male member, for holding the same together. Once again, that combination of capillary force, and frictional force, have a tendency to hold these two members together, once the beveled clasp is assembled, and tightly secure the ends of any jewelry, or the like, for its securement about the wearer. Extensive testing has proven that the clasp holds, and does not become free on its own, unless an exerting force is made upon the item of jewelry, or a slight twist is exerted upon one or the other of the male or female members, that readily provides for their quick release when it is desired to seek their disengagement.

As is known, the frictional force that is generatd between two surfaces, which exert a perpendicular force against each other, in their relationship, provides a reactional frictional force that tends to hold the components together, and the generated coefficient of friction that is exerted between these two components, resists their movement or separation relative to each other, which is what secures the beveled clasp of this invention together, and sustains its hold, in addition to the capillary surface force generated between the male and female components once they are tightly interconnected.

This type of a clasp, formed utilizing these principles of physics to sustain their connection is what makes the beveled clasp of this invention distinct from the mechanical type of couplers as previously reviewed and explained, and as shown, in the prior art.

DESCRIPTION OF THE PREFERRED EMBODIMENT

Figure 1:
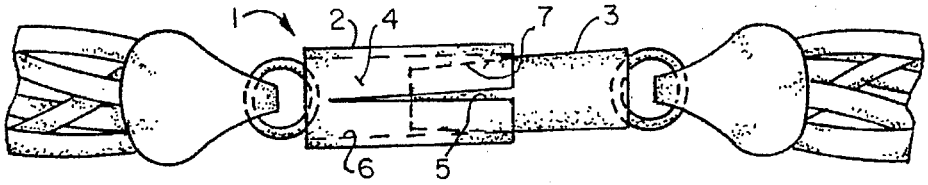
FIG. 1 is a side view of the beveled clasp of this invention, showning the ends of an item of jewelry connecting thereto.
Figure 2:
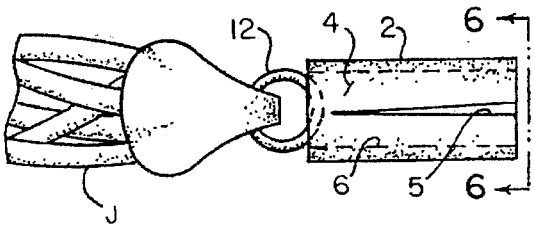
FIG. 2 and FIG. 3 provide views of the female and male members, respectively, during separation of the beveled clasp.
Figure 3:
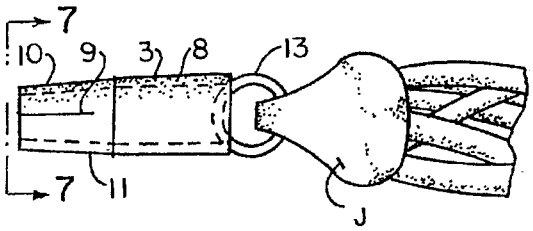

In referring to the drawings, FIGS. 1 through 3 disclose the beveled clasp of this invention. The clasp 1 is shown interconnected, wherein the female member 2 is receptive to the male member 3 and readily secures the two together, during their interconnection. As noted, the female member 2 is formed as a sleeve or cylindrical portion 4 which has at least, but preferably two, diametrically opposed slots 5 formed partially along their length, and which allows for the female member to be slightly spread, to furnish an internal contact which is complementary to the male member, while held together by surface adhesion between the two beveled members when coupled. The female member, and more specifically along its cylindrical or sleeve like portion 4, includes an interior surface 6, which due to the widening of the slots 5, during coupling, forms a mating surface engagement with the slightly beveled surface 7 of the male member 3, during interconnection. The male member 3 may also comprise or be formed of a cylindrical portion 8, and which may include one, but preferably a pair of diametrically opposed slots, as at 9, partially along its length, and wherein the outer exterior surface 10 proximate the slot 9 may be compressed, to form a slightly tapered surface, as at 11, which not only facilitates the insertion of the male member within the female member, but provides concentricity between their surfaces, to form that flush engagement that provides for the formation of the capillary forces that hold the two members together, once clasped, in addition to the frictional force that prevents their disengagement, once interconnected.

It can also be seen that various forms of linkages, such as the rings 12 and 13 may be rigidly connected to the back ends of the members, in order to provide means for interconnecting with the ends of any jewelry, such as noted at J.

Figure 4:
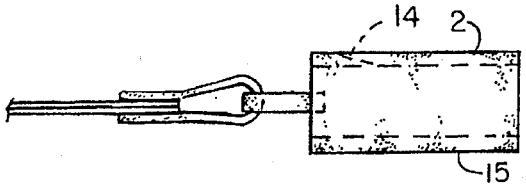
FIG. 4 and FIG. 5 show a top plan view of the beveled clasp of this invention, the female component disclosed in FIG. 4, and the male component shown in FIG. 5.
Figure 5:
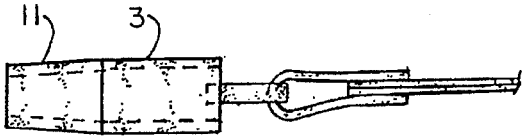

FIGS. 4 and 5 provide a top view of the beveled clasp, and its female member 2, and the male member 3, that readily shows the beveled relationship 11 proximate the forward end of the member 3. The back ends of the slots 5 formed of the female member 2 can be seen at 14 and 15.

Figure 6:
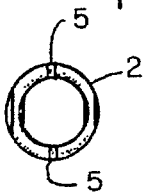
FIG. 6 is an end view of the female member of the clasp as shown in FIG. 4.
Figure 7:
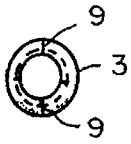
FIG. 7 is an end view of the male member of the beveled clasp a shown in FIG. 5.
Figure 8:
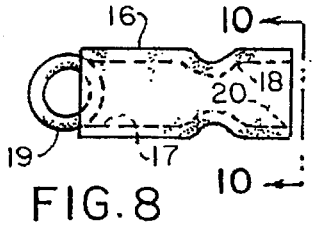
FIG. 8 shows a modification to the beveled clasp of this invention wherein a bead connection holds the female member, as shown herein, with the male member of the clasp.
Figure 9:
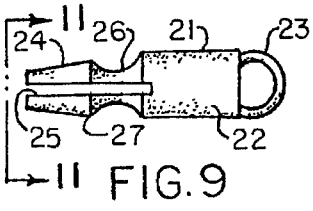
FIG. 9 discloses the male member of the beveled clasp that interconnects with the female member of FIG. 8.
Figure 10:
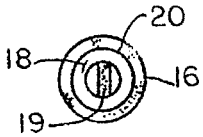
FIG. 10 is an end view of the female member of the beveled clasp as shown in FIG. 8; and, FIG. 11 is an end view of the male member of the beveled clasp as shown in FIG. 9.
Figure 11:
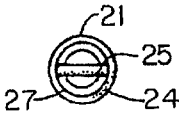

FIG. 6 provides an end view of the female component when it is slotted, and compressed, to provide a resilient type of means that can be expanded, upon insertion of the female member therein, and provide for that frictional and capillary engagement between the components and which resist their separation, unless required. Likewise, FIG. 7 discloses an end view of the male component, with its diametrically opposed slots, as at 9, and which member when compressed, forms the slight bevel, as shown in FIG. 5.

FIGS. 8 through 11 disclose a beveled clasp, of the type as referred herein, and which includes the further feature of a beaded and grooved connection that interengage and lock these components together, and secure them, unless a tensioning force is exerted upon the two components, pulling them apart, after overcoming their resistance to separation. As can be seen, the female member 16 is formed as a cylindrical portion, having an opening 17 provided through its interior, and extending substantially its length. Towards the frontal portion of the member is provided an indentation, which forms a bead 18 around the inner circumference of the member. An eyelet 19 is fastened, as by solder, or the like, at the back end, to provide for its interconnection with other components, such as the end of a necklace, bracelet, or the like. Its frontal end is opened, as at 20, and into which the male member 21 may insert. The male member also has longitudinal length, having a base 22, to which an eyelet 23 is secured, while the front of the male member 21 is contoured at a bevel, as at 24, and includes a slot 25, and an integral groove 26 proximate the frontal portion of the member 21. Thus, when the front of the member 21, and more specifically its beveled portion 24 is inserted within the female member, the slot allows a slight compressing, to provide clearance for the circumferential extremity 27 of the beveled portion to clear the bead 18, at which time further insertion of the member 21 seats the bead 18 within the groove 26, to provide a securement of these members together. A slight pulling upon the two members, as at their eyelets 19 and 23, can force their disconnection, allowing for removal of the item of jewelry, or other components to disconnection.

Variations or modifications to the subject matter of this invention may occur to those skilled in the art upon reviewing the invention as described herein. Such variations or modifications, if within the spirit of this invention, are intended to be encompassed within the scope of any claims to patent protection issuing upon this invention. The description of the preferred embodiment set forth herein is done so for illustrative purposes only.

Having thus described the invention, what is claimed and desired to be secured by Letters Patent is:

1. A clasp formed of beveled members capable of facilely securing together with a minimum of effort, sustaining their hold following their slide interfitting together, and capable of separating through the exertion of a slight twist and pulling force to cause their separation, comprising, a male member, a female member, each said male and female members having a back edge, and each member having a slight bevel provided at least partially along their length, and extending to their front edges, said female member having an interior surface along a part of its length, said male member having an exterior surface provided along a part of its length, said male member interfitting within said female member, and securing therein only through the creation of capillary and frictional forces generated between the said surfaces of the male and female members, gripping and connecting members provided at the back ends of each of said male and female members, said gripping members provided for facilitating the insertion and separation of the clasp during usage, said male and female members being formed of cylindrical shape, at least said female member having at least one longitudinal slot formed through its cylindrical shape and along a part of its length, and said slot being compressed closed to provide a bevel along the length of the female member, and which is pressured slightly opened upon insertion of the male member therein during creation of a grip, said male member having at least one slot formed along a part of its length, and said male member being compressed to close said slot and thereby form a slight decreasing tapered bevel along its length, said male member capable of interfitting within the female member to form their interconnection only through the generation of the capillary and frictional forces between said male member as interfitting within said female member.

2. A clasp formed of beveled members capable of facilely securing together with a minimum of effort sustaining their hold after their slide interfitting together, and capable of separating through a slight twist and exertion of an extracting separating force, comprising, a male member, said male member having a length, at least a part of which is formed having a tapering bevel extending longitudinally towards its front edge, a female member, said female member being formed having an integral cylindrical portion forming a complementary beveled interior portion capable of receiving the male member during their interconnection, said female member providing a beveled interior surface, said male member providing an exterior beveled portion, said male member interfitting within said female member and securing therein only through the generation of capillary and frictional forces exerted between the two members when clasped together, said male member including a slot formed partially along its longitudinal length, to provide a slight resiliency to the male member when inserted for clasping within the cylindrical portion of the complementary beveled female member, said female member also including a pair of longitudinally arranged slots partially along its length in order to facilitate the formation of its tapering bevel, and to allow its expansion during insertion of the male member therein during their interconnection.

* * * * *